US006343838B1

(12) United States Patent
Bagshaw

(10) Patent No.: US 6,343,838 B1
(45) Date of Patent: Feb. 5, 2002

(54) RECLINABLE SWING CHAIR

(76) Inventor: Fred Bagshaw, 226 McNab Street, Dundas, Ontario (CA), L9H 2K1

( * ) Notice: Subject to any disclaimer, the term of this patent is extended or adjusted under 35 U.S.C. 154(b) by 0 days.

(21) Appl. No.: 09/642,845

(22) Filed: Aug. 22, 2000

(51) Int. Cl.[7] ..... A47D 13/10
(52) U.S. Cl. ..... 297/278; 297/280; 5/123
(58) Field of Search ..... 297/273, 276, 297/277, 278, 280, 281, 282; 5/98.3, 120, 123, 125

(56) References Cited

U.S. PATENT DOCUMENTS

| | | | | | |
|---|---|---|---|---|---|
| 580,076 | A | * | 4/1897 | Wohler | 297/278 X |
| 597,991 | A | * | 1/1898 | Lease | 297/278 X |
| 1,405,768 | A | * | 2/1922 | Ekehorn | 297/278 |
| 2,080,795 | A | * | 5/1937 | Stone | 297/280 X |
| 2,097,884 | A | | 11/1937 | Kann | |
| 2,487,907 | A | | 11/1949 | Turner | |
| 4,221,429 | A | * | 9/1980 | Wade | 297/277 |
| 4,268,087 | A | | 5/1981 | Sorrentino | |
| 4,351,524 | A | | 9/1982 | Gomes | |
| 4,478,409 | A | | 10/1984 | Eads et al. | |
| 4,478,410 | A | | 10/1984 | Ziegler, Jr. | |
| 4,917,378 | A | | 4/1990 | Girecky et al. | |
| 5,058,951 | A | | 10/1991 | Thiel | |
| 5,842,741 | A | * | 12/1998 | Onorini | 297/273 X |
| 5,851,053 | A | * | 12/1998 | Crawford | 297/273 |
| 5,876,289 | A | | 3/1999 | Liu | |
| 6,036,605 | A | | 3/2000 | Tseng | |

FOREIGN PATENT DOCUMENTS

| | | |
|---|---|---|
| GB | 567292 | 2/1945 |

* cited by examiner

*Primary Examiner*—Laurie K. Cranmer
(74) *Attorney, Agent, or Firm*—Ingrid E. Schmidt

(57) ABSTRACT

A reclinable swing chair is provided that may be moved between a reclined and an upright position. The reclinable swing chair has a body, a pair of rope supports and a pair of adjustable arms. The reclinable swing chair is suspended from a frame. The frame has a horizontally extending supporting member and a leg assembly to support the frame. The body has a seat portion and a back rest portion. The rope supports are attached at opposite sides of the body and have front and back loop portions that converge at a suspension point to suspend the swing chair. The adjustable arms are attached to the front loop portions of the rope supports at a front end and slidingly receive the back loop portion at a back end. The back end can move along the back loop portion between a first position adjacent the back seat portion and a second position spaced from the back seat portion so that the swing chair may be moved between a reclined and an upright position.

9 Claims, 3 Drawing Sheets

RECLINABLE SWING CHAIR

FIELD OF THE INVENTION

This invention relates to swing chairs and more particularly to a reclinable swing chair with a seat portion and a back rest portion that allows angular movement between the two portions.

BACKGROUND OF THE INVENTION

Swing chairs are generally used outdoors and have a seat portion that is attached to a frame. The seat portion is generally made from one piece of material and has a seat and a back rest. The seat and the back rest may be manufactured separately and then attached together to form the seat portion.

Some swing chairs may have seats that are adjustable to allow a user to position the seat for their comfort. The adjustment mechanisms may be located in a position on the seat that may make it awkward for a user to reach and therefore easily adjust the position of the seat while seated. Some adjustments mechanisms use metal chains that contain chain links which may cause an injury to the user if they are not cautious and accidentally catch themselves in the chain when the seat is being adjusted or while it is swinging.

Stationary chairs are known that have seats made from a series of slats that are strung together on a frame. These chairs are generally rigid structures and are not designed to be suspended from a frame or similar supporting object, and therefore cannot be used as a swing.

It is therefore desirable to provide a reclinable swing chair. It is further desirable to provide a reclinable swing chair that allows a user to position the chair between an upright and a reclined position, that is safe and easily manipulated by a user.

SUMMARY OF THE INVENTION

In a broad aspect, the invention provides a reclinable swing chair that may be moved between a reclined and an upright position. The reclinable swing chair has a body, a pair of rope supports and a pair of adjustable arms. The body has a seat portion and a back rest portion. The rope supports are attached at opposite sides of the body and have front and back loop portions that converge at a suspension point to suspend the swing chair. The adjustable arms are attached to the front loop portions of the rope supports at a front end and slidingly receive the back loop portion at a back end. The back end can move along the back loop portion between a first position adjacent the back seat portion and a second position spaced from the back seat portion so that the swing chair may be moved between a reclined and an upright position.

In a preferred embodiment of the reclinable swing chair, a frame is included to suspend the swing chair. The frame includes a supporting member to which the swing chair is attached and a leg assembly that supports the frame in an upright position during use.

BRIEF DESCRIPTION OF THE DRAWINGS

The invention is better understood in reference to the drawings, and following description, in which.

DESCRIPTION OF THE PREFERRED EMBODIMENT

Figure 1:
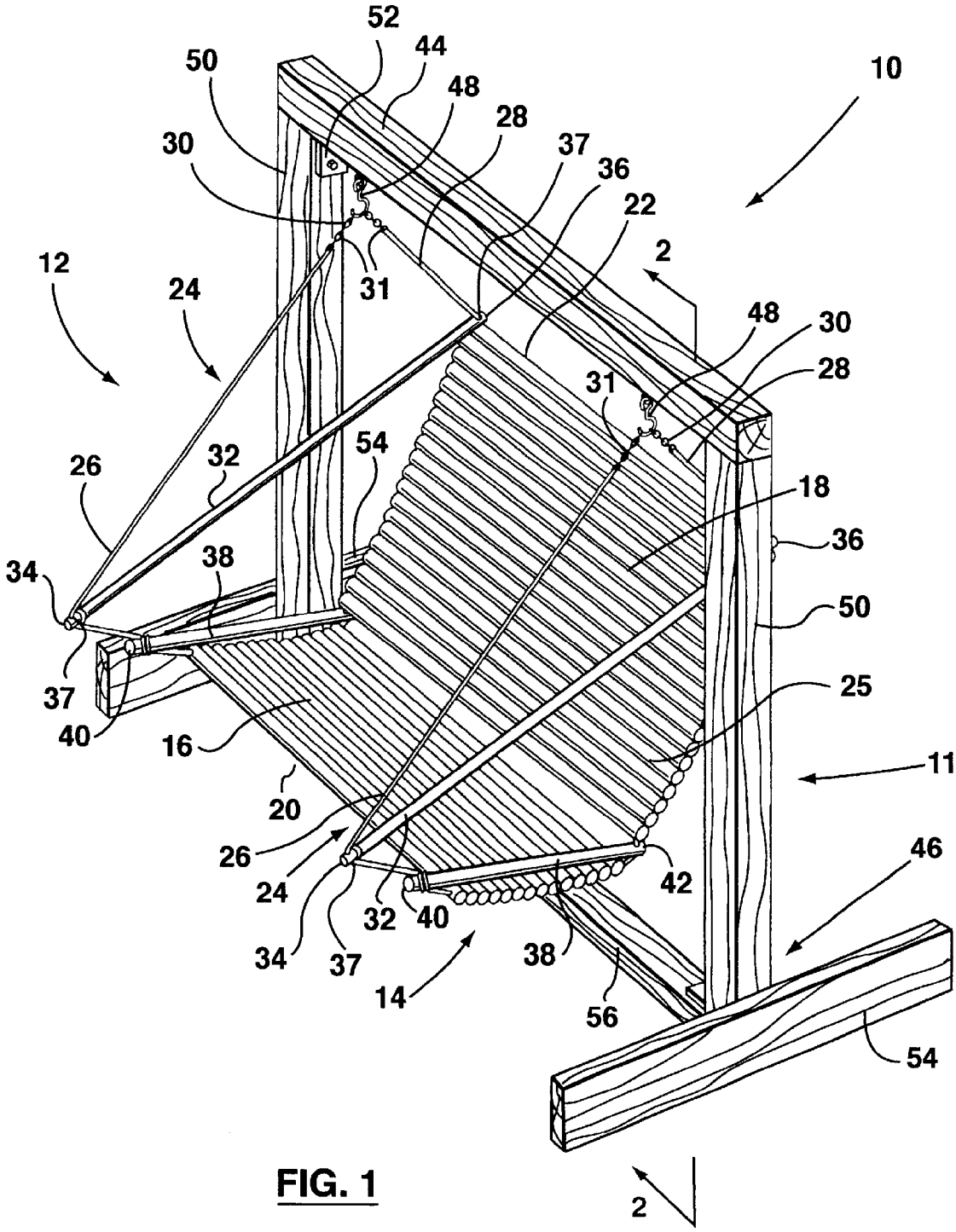
FIG. 1 is an isometric view of a reclinable swing chair assembly according to a preferred embodiment of the invention, having a frame and a swing chair in a reclined position.

Reference is first made to FIG. 1 to describe a preferred embodiment of a reclinable swing chair assembly, in accordance with the invention, designated generally by the numeral 10. The swing chair assembly 10 includes a frame 11 and a swing chair 12. The swing chair 12 has a body 14 with a seat portion 16 and a back rest portion 18 that define a forward edge 20 and a rear edge 22 respectively. The body 14 is suspended by a pair of rope supports 24 that are disposed on opposite sides of the body 14 and attached to the forward edge 20 and the rear edge 22.

It will be evident that the seat portion 16 and the back rest portion 18 will be of a similar width in order to provide an equally proportioned seat. The back rest portion 18 may have a substantially greater depth in order to provide suitable support for a person's back while seated. The body 14 can be sized to provide a swing chair in varying widths that can be suitable for one or more persons.

Figure 4:
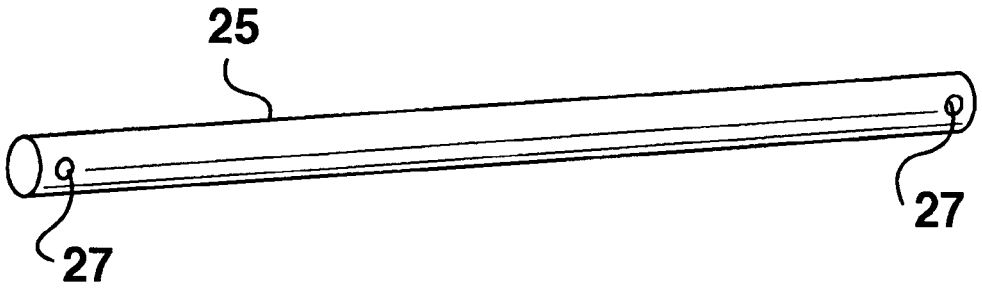
FIG. 4 is an isometric view of a rung forming part of the swing chair assembly.

The seat portion 16 and the back rest portion 18 comprise a plurality of longitudinally extending rungs 25, positioned parallel to the forward edge 20 and the rear edge 22. Each of the rungs 25 has openings 27 (FIG. 4) located at opposite ends for receiving the rope supports 24. When the swing chair 12 is manufactured, the rungs 25 are threaded along the rope supports 24 by passing the rope supports 24 through the respective openings 27.

The rope supports 24 define a front loop portion 26 and a back loop portion 28 that converge at a suspension point 30 to suspend the swing chair 12. The back loop portion 28 extends from the suspension point 30 past the rear edge 22 and through the rungs 25 located in the back rest portion 18. In a similar manner, the front loop portion 26 extends from the suspension point 30 past the forward edge 20 and through the rungs 25 located in the seat portion 16 to meet the back loop portion 28 at the back rest portion 18. The rope supports 24 are each made from a continuous integral length of rope, with a few chain links 31 attached at each end, that meet at the suspension point 30.

Figure 3:
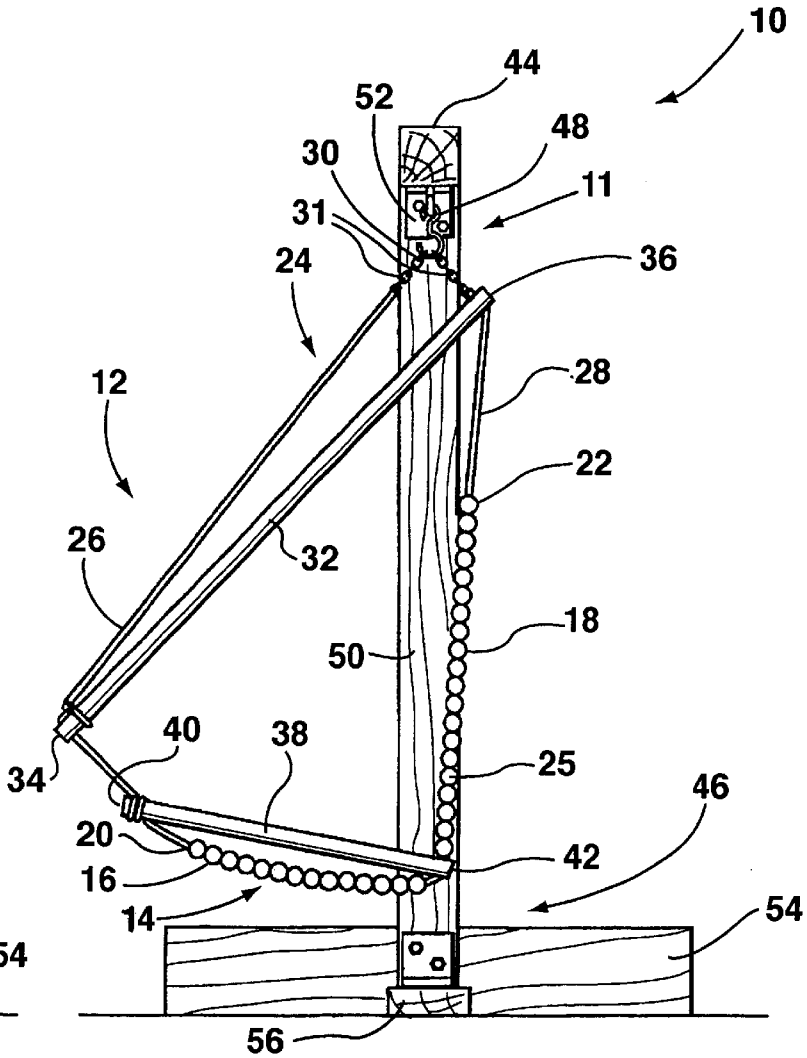
FIG. 3 is a partially sectional end elevation of the swing chair assembly drawn on line 2—2 of FIG. 1, with the swing chair shown in an upright position.
Figure 2:
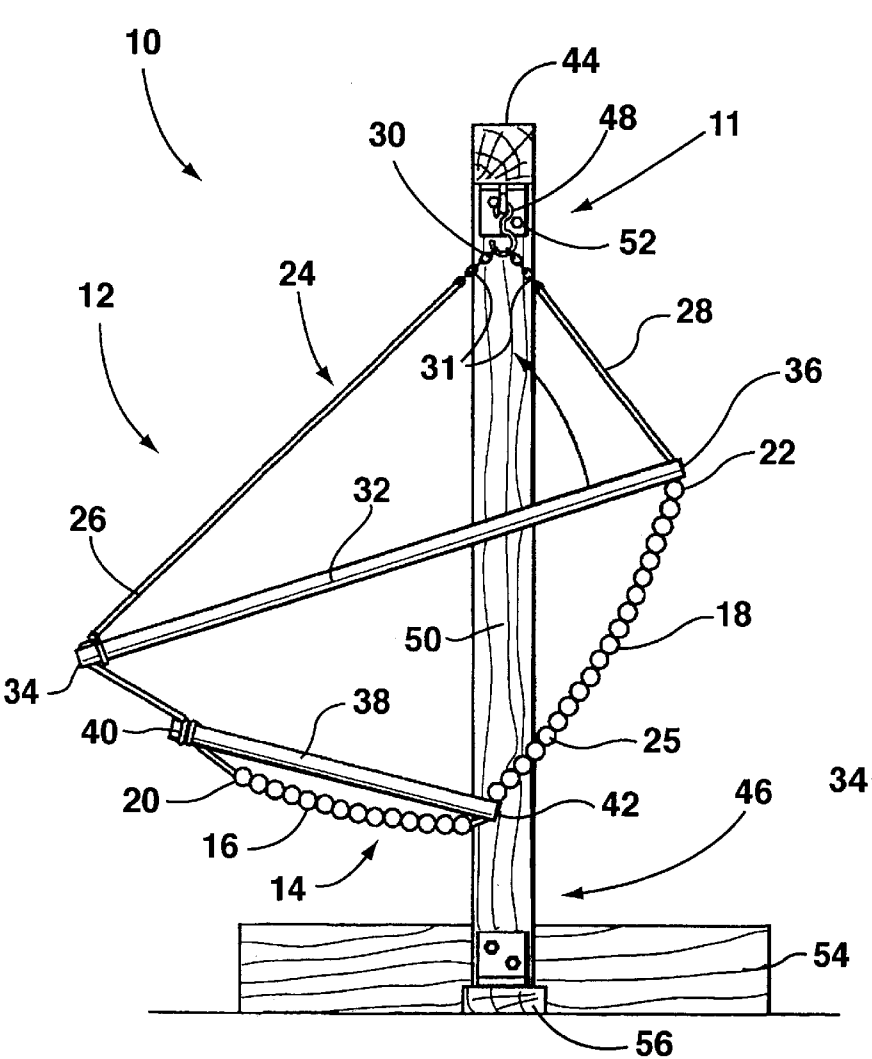
FIG. 2 is a partially sectional end elevation of the swing chair assembly drawn on line 2—2 of FIG. 1.

A pair of adjustable arms 32 are provided for moving the swing chair 12 between a reclined and an upright position, as shown in FIGS. 2 and 3. Each arm 32 has a front end 34 and a back end 36. The arms 32 are solid cylindrical pieces of wood with openings 37 located at least at the back end 36, and preferably also at the front end 34. The front end 34 is fixedly attached to the front loop portion 26 and the back end 36 slidingly receives the back loop portion 28 through the openings 37 for moving the arms 32 along the back loop portion 28.

As a result, the arms 32 can be moved between a first and a second position. In the first position, the back end 36 is located adjacent the rear edge 22 of the back rest portion 18 and forces the front loop portion 26 away from the back loop portion 28 which in turn positions the back rest portion 18 in a reclined position, as shown in FIG. 2. In the second position, the back end 36 is located spaced from the rear edge 22, towards the suspension point 30 in the direction of arrow A on FIG. 2. Movement of the arms 32 to the second position will simultaneously move the back loop portion 28 towards the front loop portion 26, bringing the back rest portion 18 to a substantially upright position, as shown in FIG. 3.

To provide further rigidity to the swing chair 12, a pair of braces 38 may also be included in the body 14. Similar to the arms 32, the braces 38 also have a front end 40, and a back end 42. The front end 40 is attached to the front loop portion 26 between the arms 32 and the forward edge 20. The back end 42 is attached to the front loop portion 26 between the seat portion 16 and the back rest portion 18 and is restricted in movement by the seat portion 16 and the back rest portion 18.

The swing chair 12 is suspended from a lumber frame 11. The frame 11 has a horizontally extending supporting member 44 maintained in a position spaced from the ground, or other suitable supporting surface, by a leg assembly 46. The supporting member 44 is sized to have a greater width than the body 14. The swing chair 12 is attached to the supporting member 44 at a connection means in the form of a pair of hooks 48 located on the supporting member 44 and screwed into a bottom facing edge so as to be spaced at a distance corresponding to the width of the body 14. The location of the connection means 48 must be accessible to allow the attachment and suspension of the swing chair 12.

As mentioned previously, the leg assembly 46 supports the supporting member 44 and maintains it in spaced relation from the ground when the swing chair assembly 10 is in use. In its preferred form, leg assembly 46 has a pair of upright posts 50 perpendicularly extending from the supporting member 44 at each end towards the ground or other supporting surface when the swing chair assembly 10 is in use. The posts 50 are coupled to the supporting member using a pair of angle irons 52. To provide support, a pair of horizontally spaced parallel feet 54 are attached at the opposite ends of the posts 50 from the supporting member 44. The feet 54 are located perpendicularly to the end of the posts 50 and extend beyond the width of the posts 50. The feet 54 can be detached from the frame 11 when the structure is stored to reduce the amount of space required for storage. A beam 56 located near the ground and in parallel relation to the supporting member 44 at the opposite end of the posts 50, and attached to the posts 50 at opposing ends, provides additional support to the frame 11.

In use, in its preferred form, the swing chair assembly 10 is assembled as shown in FIG. 1. The frame 11 is positioned to be able to support the swing chair 12, with leg assembly 46 supporting the supporting member 44 in an upright position. The hooks 48 are located on the downwardly facing surface of the supporting member 44 and the swing chair 12 is suspended from the frame 11 by attaching a selected one of the chain links 31 forming part of the rope supports 24 to a respective hook 48. The swing chair 12 is now operable to suspend and to swing.

When the back end 36 of the arms 32 is located adjacent the rear edge 22, the swing chair 12 is in a reclined position, as shown in FIG. 2. In this position, arms 32 are operable to slidingly move along back loop portion 28 towards the suspension point 30, in the direction of arrow A, as shown in FIG. 2.

In order to position the swing chair 12 in an upright position, arms 32 are moved from the first position to the second position locating the back end 36 adjacent the suspension point 30. FIG. 3 shows the swing chair 12 in an upright position with the back end 36 of arms 32 abutting the suspension point 30. The swing chair 12 is operable to be positioned in either the reclined or the upright position as required by a user.

The preferred embodiment can be modified in many ways. For instance, the preferred form of the body 14 may be made from a continuous flexible material such as a fabric that can be attached to the rope supports 24 along a seam. The body 14 may also be made from longitudinally extending rungs that form a continuous body. Similarly the rope supports 24 can be made from a continuous integral length of rope or a series of rope portions connected together. The rope supports 24 can have different ends, such as one chain link or an integral eye, that meet at suspension point 30 and are operable to connect to connection means 48. Any material that is strong enough to suspend the swing chair 12 and any load placed in it and that can form a rope-like structure capable of being attached to the body 14 may be used. Similarly, frame 11 can be made from any material suitable to suspend the swing chair 12, such as a composite plastic material or a suitable metal.

The swing chair 12 can be suspended from any structure that is strong enough to support it and that allows the full range of swing motion, such as a large tree branch, or an internal ceiling beam in a building. The connection means 48 may be any means of connection that allows the swing chair 12 to be suspended, such as a hole through which the rope supports 24 can be passed and then attached to the top side of the supporting member 44.

Other such variations as will be appreciated by those skilled in the art may be made within the scope of the appended claims.

What is claimed is:

1. A reclinable swing chair having:

a body having a seat portion and a back rest portion defining a forward edge and a rear edge, respectively;

a pair of rope supports, each rope support being disposed on opposite sides of the body and coupled to said forward edge and rear edge of the body, the rope supports defining front and back loop portions adapted to converge at a suspension point to suspend the swing chair; and a pair of adjustable arms, each arm having a front end coupled to the front loop portion and a back end slidingly receiving the back loop portion for movement between a first position adjacent said rear edge of the body and a second position spaced from said rear edge of the body so that the swing chair may be moved between a reclined position and an upright position.

2. A reclinable swing chair according to claim 1, wherein each rope support is a continuous integral length of rope having a few chain links attached at each end for coupling to a hook.

3. A reclinable swing chair having:

a body having a seat portion and a back rest portion defining a forward edge and a rear edge, respectively, the seat portion and the back rest portion comprising a plurality of longitudinally extending rungs disposed in parallel relation to the forward edge and the rear edge, the rungs having openings located at opposite ends thereof;

a pair of rope supports each disposed on opposite sides of the body and received through the openings in the rungs, the supports defining front and back loop portions adapted to converge at a suspension point to suspend the swing chair;

a pair of braces, each brace having a front end coupled to the front loop portion proximate to the forward edge of the seat portion and a back end coupled to the front loop portion between the seat portion and the back rest portion; and a pair of adjustable arms, each arm having a front end coupled to the front loop portion between the suspension point and the associated brace, and a back end slidingly receiving the back loop portion for movement between a first position adjacent said rear edge of the body and a second position spaced from said rear edge of the body so that the swing chair may be moved between a reclined position and an upright position.

4. A reclinable swing chair according to claim 3, wherein each rope support is a continuous integral length of rope having a few chain links attached at each end for coupling to a hook.

5. A reclinable swing chair assembly comprising a frame and a reclinable swing chair, having:

the frame having an elongated horizontally extending supporting member, a leg assembly attached to said supporting member and extending downwardly therefrom to maintain the frame in an upright position, the supporting member being spaced in use from a supporting surface and adapted to suspend the swing chair;

the swing chair having body having a seat portion and a back rest portion defining a forward edge and a rear edge, respectively, the seat portion and the back rest portion comprising a plurality of longitudinally extending rungs disposed in parallel relation to the forward edge and the rear edge, the rungs having openings located at opposite ends thereof;

a pair of rope supports each disposed on opposite sides of the body and received through the openings in the rungs, the supports defining front and back loop portions adapted to converge and attached to the supporting member to suspend the swing chair;

a pair of braces, each brace having a front end coupled to the front loop portion proximate to the forward edge of the seat portion and a back end coupled to the front loop portion between the seat portion and the back rest portion; and a pair of adjustable arms, each arm having a front end coupled to the front loop portion in spaced relation to the braces and a back end slidingly receiving the back loop portion for movement between a first position adjacent said rear edge of the body and a second position spaced from said rear edge of the body so that the swing chair may be moved between a reclined position and an upright position.

6. The reclinable swing chair assembly of claim 5, wherein the supporting member further has a connection means attached to said supporting member and operable to suspend the body therefrom.

7. The reclinable swing chair assembly of claim 6, wherein the connection means comprises a pair of hooks and the rope supports have ends for coupling to the hooks.

8. A reclinable swing chair assembly according to claim 5, wherein the leg assembly includes a pair of transversely extending feet to stabilise the frame.

9. A reclinable swing chair assembly according to claim 8, wherein the feet are releasably attached to the leg assembly and may be removed for storage.

* * * * *